US007731195B2

(12) United States Patent
Woodbury et al.

(10) Patent No.: US 7,731,195 B2
(45) Date of Patent: Jun. 8, 2010

(54) VIDEO POKER GAME HAVING SECOND DRAW OPTION

(76) Inventors: Christopher M. Woodbury, 3328 E. Charleston, Las Vegas, NV (US) 89104; Floyd H. Rollinson, 3328 E. Charleston, Las Vegas, NV (US) 89104

( * ) Notice: Subject to any disclaimer, the term of this patent is extended or adjusted under 35 U.S.C. 154(b) by 562 days.

(21) Appl. No.: 11/678,015

(22) Filed: Feb. 22, 2007

(65) Prior Publication Data

US 2007/0298855 A1 Dec. 27, 2007

(51) Int. Cl.
*A63F 1/00* (2006.01)

(52) U.S. Cl. ..... 273/292; 463/13

(58) Field of Classification Search ..... 463/13, 463/16, 18, 25; 273/292, 139, 138.1, 138.2, 273/274, 309; 705/14.15; 709/224
See application file for complete search history.

(56) References Cited

U.S. PATENT DOCUMENTS

| | | | | |
|---|---|---|---|---|
| 5,511,781 | A | 4/1996 | Wood et al. | |
| 6,045,129 | A | 4/2000 | Cooper et al. | |
| 6,257,979 | B1 | 7/2001 | Walker et al. | |
| 6,270,405 | B1 | 8/2001 | Ferguson | |
| 6,592,456 | B2 | 7/2003 | Walker et al. | |
| 2002/0198040 | A1 | 12/2002 | Moody | |
| 2003/0022713 | A1 | 1/2003 | Jasper et al. | |
| 2004/0033830 | A1 | 2/2004 | Gold et al. | |
| 2006/0226604 | A1 * | 10/2006 | Saucier | 273/292 |
| 2007/0241504 | A1 * | 10/2007 | Mou et al. | 273/292 |

* cited by examiner

*Primary Examiner*—Peter DungBa Vo
*Assistant Examiner*—Masud Ahmed
(74) *Attorney, Agent, or Firm*—Greenberg Traurig

(57) ABSTRACT

A method of conducting a video poker game is disclosed. The method comprises offering players an option to draw cards a second time in response to an initial hand meeting certain pre-established requirements. For example, if an initial hand having five cards includes four cards to a royal flush or straight flush, or three cards to a four of a kind, the player may be provided with the second draw opportunity. The player may also have to hold the pre-established cards. To participate in the second draw opportunity the player places a second wager such that payouts are provided from a second pay table wherein certain payouts are decreased over those found in a pay table associated with one draw outcomes. In some versions, the second draw opportunity is only provided to players placing a first wager meeting or exceeding a minimum threshold value (e.g., maximum coins or units).

22 Claims, 11 Drawing Sheets

| Hand | 1 Credit | 2 Credits | 3 Credits | 4 Credits | 5 Credits |
|---|---|---|---|---|---|
| Royal Flush | 250 | 500 | 750 | 1000 | 4000 |
| Straight Flush | 50 | 100 | 150 | 200 | 250 |
| Four Of A Kind | 25 | 50 | 75 | 100 | 125 |
| Full House | 9 | 18 | 27 | 36 | 45 |
| Flush | 6 | 12 | 18 | 24 | 30 |
| Straight | 4 | 8 | 12 | 16 | 20 |
| Three Of A Kind | 3 | 6 | 9 | 12 | 15 |
| Two Pair | 2 | 4 | 6 | 8 | 10 |
| Jacks Or Better | 1 | 2 | 3 | 4 | 5 |

*FIG. 2A*

PRIOR ART-Jacks or Better

| Hand | 1 Credit | 2 Credits | 3 Credits | 4 Credits | 5 Credits |
|---|---|---|---|---|---|
| Natural Royal Flush | 300 | 600 | 900 | 1200 | 4000 |
| Four Deuces | 200 | 400 | 600 | 800 | 1000 |
| Wild Royal Flush | 25 | 50 | 75 | 100 | 125 |
| Five Of A Kind | 15 | 30 | 45 | 60 | 75 |
| Straight Flush | 9 | 18 | 27 | 36 | 45 |
| Four Of A Kind | 5 | 10 | 15 | 20 | 25 |
| Full House | 3 | 6 | 9 | 12 | 15 |
| Flush | 2 | 4 | 6 | 8 | 10 |
| Straight | 2 | 4 | 6 | 8 | 10 |
| Three Of A Kind | 1 | 2 | 3 | 4 | 5 |

*FIG. 2B*

PRIOR ART-Deuces Wild

| Hand | 1 Credit | 2 Credits | 3 Credits | 4 Credits | 5 Credits |
|---|---|---|---|---|---|
| Royal Flush | 250 | 500 | 750 | 1000 | 4000 |
| Straight Flush | 50 | 100 | 150 | 200 | 250 |
| Four Aces | 160 | 320 | 480 | 640 | 800 |
| Full House | 10 | 20 | 30 | 40 | 50 |
| Flush | 7 | 14 | 21 | 28 | 35 |
| Straight | 5 | 10 | 15 | 20 | 25 |
| Three Of A Kind | 3 | 6 | 9 | 12 | 15 |
| Two Pair | 1 | 2 | 3 | 4 | 5 |
| Jacks Or Better | 1 | 2 | 3 | 4 | 5 |

*FIG. 2C*

PRIOR ART-Double Bonus

| Hand | 1 Credit | 2 Credits | 3 Credits | 4 Credits | 5 Credits |
|---|---|---|---|---|---|
| Royal Flush | 250 | 500 | 750 | 1000 | 4000 |
| Straight Flush | 50 | 100 | 150 | 200 | 250 |
| Four Aces w/2,3, or 4 | 400 | 800 | 1200 | 1600 | 2000 |
| Four 2,3, or 4 w/A-4 | 160 | 320 | 480 | 640 | 800 |
| Four Aces | 160 | 320 | 480 | 640 | 800 |
| Four 2,3, or 4 | 80 | 160 | 240 | 320 | 400 |
| Four 5-K | 50 | 100 | 150 | 200 | 250 |
| Full House | 10 | 20 | 30 | 40 | 50 |
| Flush | 6 | 12 | 18 | 24 | 30 |
| Straight | 4 | 8 | 12 | 16 | 20 |
| Three Of A Kind | 3 | 6 | 9 | 12 | 15 |
| Two Pair | 1 | 2 | 3 | 4 | 5 |
| Jacks Or Better | 1 | 2 | 3 | 4 | 5 |

*FIG. 2D*

PRIOR ART-Double Double Bonus

| Hand | 1 Credit | 2 Credits | 3 Credits | 4 Credits | 5 Credits |
|---|---|---|---|---|---|
| Royal Flush | 250 | 500 | 750 | 1000 | 4000 |
| Straight Flush | 50 | 100 | 150 | 200 | 250 |
| Four Aces | 80 | 160 | 240 | 320 | 400 |
| Four 2,3, or 4 | 40 | 80 | 120 | 160 | 200 |
| Four 5-K | 25 | 50 | 75 | 100 | 125 |
| Full House | 7 | 14 | 21 | 28 | 35 |
| Flush | 5 | 10 | 15 | 20 | 25 |
| Straight | 4 | 8 | 12 | 16 | 20 |
| Three Of A Kind | 3 | 6 | 9 | 12 | 15 |
| Two Pair | 2 | 4 | 6 | 8 | 10 |
| Jacks Or Better | 1 | 2 | 3 | 4 | 5 |

*FIG. 2E*

PRIOR ART-5/7 Bonus Poker

300

| Hand | 1 Credit | 2 Credits | 3 Credits | 4 Credits | 5 Credits |
|---|---|---|---|---|---|
| Royal Flush | 125 | 250 | 375 | 500 | 2000 |
| Straight Flush | 25 | 50 | 75 | 100 | 125 |
| Four Of A Kind | 12 | 25 | 37 | 50 | 62 |
| Full House | 9 | 18 | 27 | 36 | 45 |
| Flush | 6 | 12 | 18 | 24 | 30 |
| Straight | 4 | 8 | 12 | 16 | 20 |
| Three Of A Kind | 3 | 6 | 9 | 12 | 15 |
| Two Pair | 2 | 4 | 6 | 8 | 10 |
| Jacks Or Better | 1 | 2 | 3 | 4 | 5 |

*FIG. 9*

VIDEO POKER GAME HAVING SECOND DRAW OPTION

FIELD OF THE INVENTION

The embodiments of the present invention relate to a video poker game having a second chance option whereby a player is afforded a second chance to draw one or more desired cards.

BACKGROUND

Video poker remains a very popular game in casinos and other gaming establishments. Conventional video poker consists of a player placing a wager of one to five coins or units. The player is then shown five cards, from a simulated deck of 52 cards, on a video poker display. The player may then elect which cards to hold and discard. All discards are then replaced with new cards from the deck. The player receives a payout, if any, based on the strength of the poker hand after the draw. However, even with the popularity of video poker, players are often frustrated that they are unable to obtain certain low frequency hands (e.g., royal flush). For example, the probability of hitting or obtaining a royal flush after a single draw is approximately once in every 40,000 hands.

All things being equal, frustrated players tend to play casino games (e.g., video poker) for shorter periods of time than content players. Such shorter play sessions negatively impact the revenue of the casino.

Therefore, it would be advantageous to provide video poker players with multiple draw opportunities to provide players increased chances of obtaining low frequency hands while increasing play sessions and house revenue.

SUMMARY

Accordingly, a first embodiment of the present invention is a method of conducting a poker game comprising: allowing a player to place a first wager; providing the player with a plurality of random face-up cards forming an initial hand; if the random face-up cards comprise one or more pre-established poker hands, triggering a second draw opportunity; allowing for a first time the player to hold or discard each of the provided random cards; replacing each discard with first new random card; if the second draw opportunity has been triggered, affording the player, for a second wager, a second opportunity to hold or discard one or more of the provided random cards; if the player elects the second draw opportunity, allowing for a second time the player to hold or discard one or more of the provided random cards and replacing each discard with a second new random card; and providing a payout from a two draw pay table to the player based on a rank of a final poker hand.

In one embodiment of the present invention, the second draw opportunity is activated in response to an initial dealt or provided five-card hand including four cards to a royal flush or straight flush, or three cards to a four of a kind, such that if after the first draw opportunity, the player does not hit or obtain target hands comprising the royal flush, straight flush or four of a kind he or she may place a second wager equal to the first wager for a second opportunity to hit or obtain royal flush, straight flush or four of a kind. The payouts from a second (two draw) pay table for the royal flush, straight flush and four of a kind are reduced from a first (one draw) pay table.

The embodiments of the present invention may be facilitated by electronic gaming devices or machines, hand-held devices or a global computer network (e.g., the Internet).

Other variations, embodiments and features of the present invention will become evident from the following detailed description, drawings and claims.

BRIEF DESCRIPTION OF THE DRAWINGS

FIG. 2*a*-2*e* illustrate various pay tables associated with conventional video poker games;

FIG. 9 illustrates an exemplary pay table according to the embodiments of the present invention.

DETAILED DESCRIPTION

Figure 1:
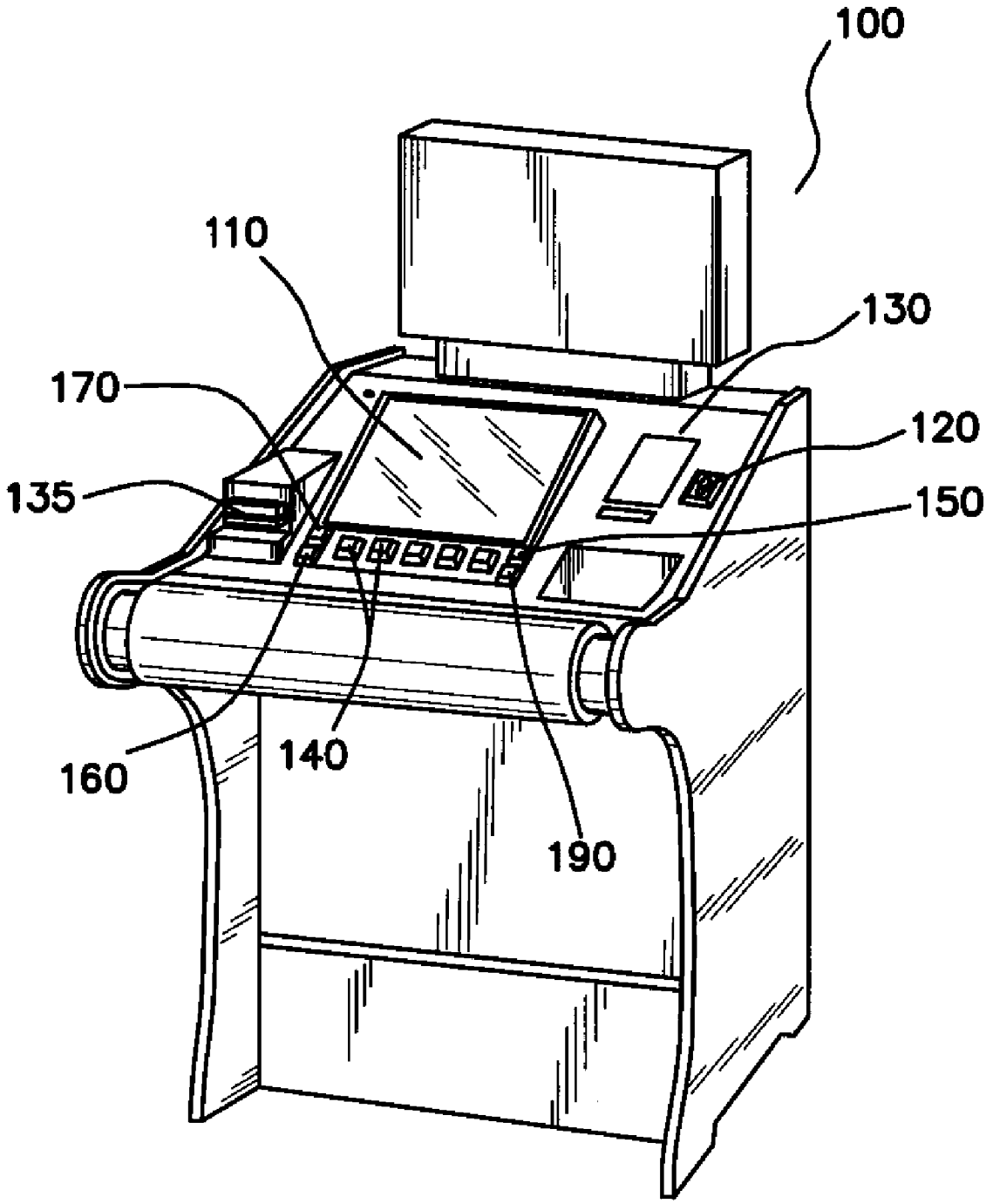
FIG. 1 illustrates a conventional video poker style machine.

For the purpose of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Video poker machines and devices have been in existence for many years. Video poker machines utilize a processor that randomly organizes a deck of simulated cards. Once a wager is placed, the order of the shuffled cards is typically set. Cards are then provided to the player in order off the top of the deck. Reference is now made to the figures wherein like parts are referred to by like numerals throughout. FIG. 1 illustrates an exemplary video poker machine generally referred to by reference numeral 100. The machine 100 includes a display 110, coin input 120, bill or coupon acceptor 130, card reader 135 and interface buttons, including hold/discard buttons 140, deal/draw button 150, cash out button 160, bet one coin button 170 and bet max coins button 190. In lieu of, or in addition to, all operations achieved using the interface buttons may be accomplished via touch screen implementation. For the embodiments herein described, the operation of the conventional video poker machine remains relatively unchanged except for the modifications disclosed and detailed below.

FIGS. 2*a*-2*e* show various pay tables associated with different one-draw, video poker games currently on the market. Each of the pay tables has slightly modified payouts based on the game type. More particularly, FIGS. 2*a*-2*e* show pay tables for Jacks or Better, Deuces Wild, Double Bonus Poker, Double Bonus Poker and 5/7 Bonus Poker, respectively.

Figure 3:
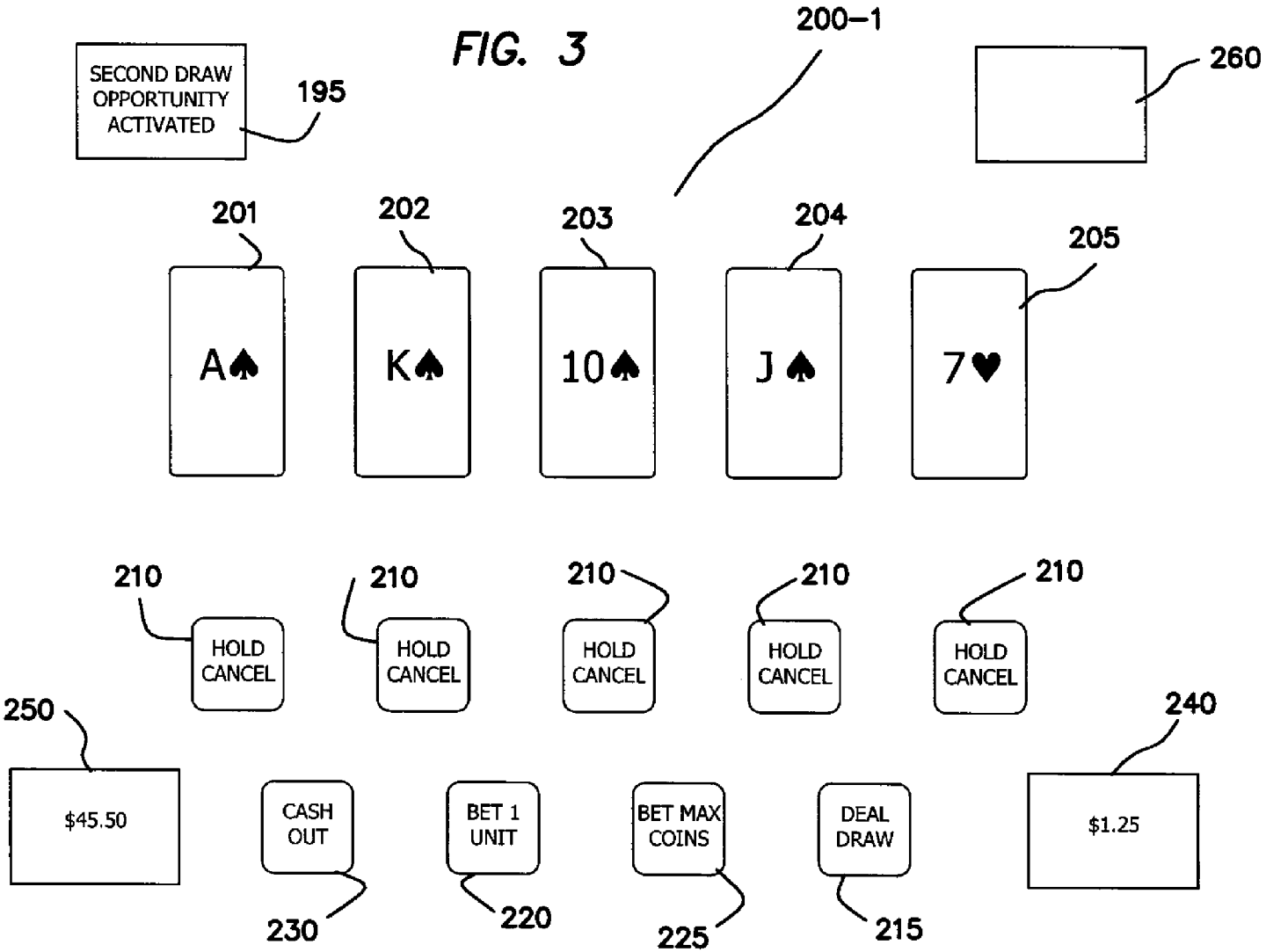
FIG. 3 illustrates a first screen shot of a video poker device according to the embodiments of the present invention.

FIG. 3 shows a first screen shot 200-1 of one embodiment of the present invention. All screen shots are depicted as though touch screen technology has been employed. As shown, the screen shot 200-1 shows hold/discard icons 210, deal/draw icon 220 and cash out icon 230. The screen 200 also provides game information via a number of credits played window 240, showing a $1.25 wager representing maximum coins on a quarter machine, number of total credits available window 250 and a payout window 260. A conventional pay table may also be displayed.

Screen shot 200-1 depicts an initial hand comprising an A♠201, K♠202, 10♠203, J♠204 and 7♥ 205. In one embodiment of the present invention, an initial hand comprising four cards to a royal flush or straight flush, or three cards to a four of a kind, activates or triggers a second draw opportunity. Those skilled in the art will understand that any desired initial hand (e.g., four cards to a straight or two pair) may be used to trigger or activate the second draw opportunity. As shown in FIG. 3, the initial hand comprises four cards, namely the A♠ 201, K♠202, 10♠203 and J♠204 to a royal flush. Therefore, the second opportunity draw is triggered internally by the processor allowing the player an opportunity, later during the game, to take advantage of the second draw opportunity. In one embodiment, a second draw opportunity icon 195 appears on the screen to alert the player of the second draw opportunity. It is also conceivable that the second draw opportunity may be limited to players playing maximum coins or units or some other minimum wager threshold. In addition, the second draw opportunity may only be triggered if the player holds the triggering cards (e.g., four cards to the Royal) after the initial hand and during the second hand.

Figure 4:
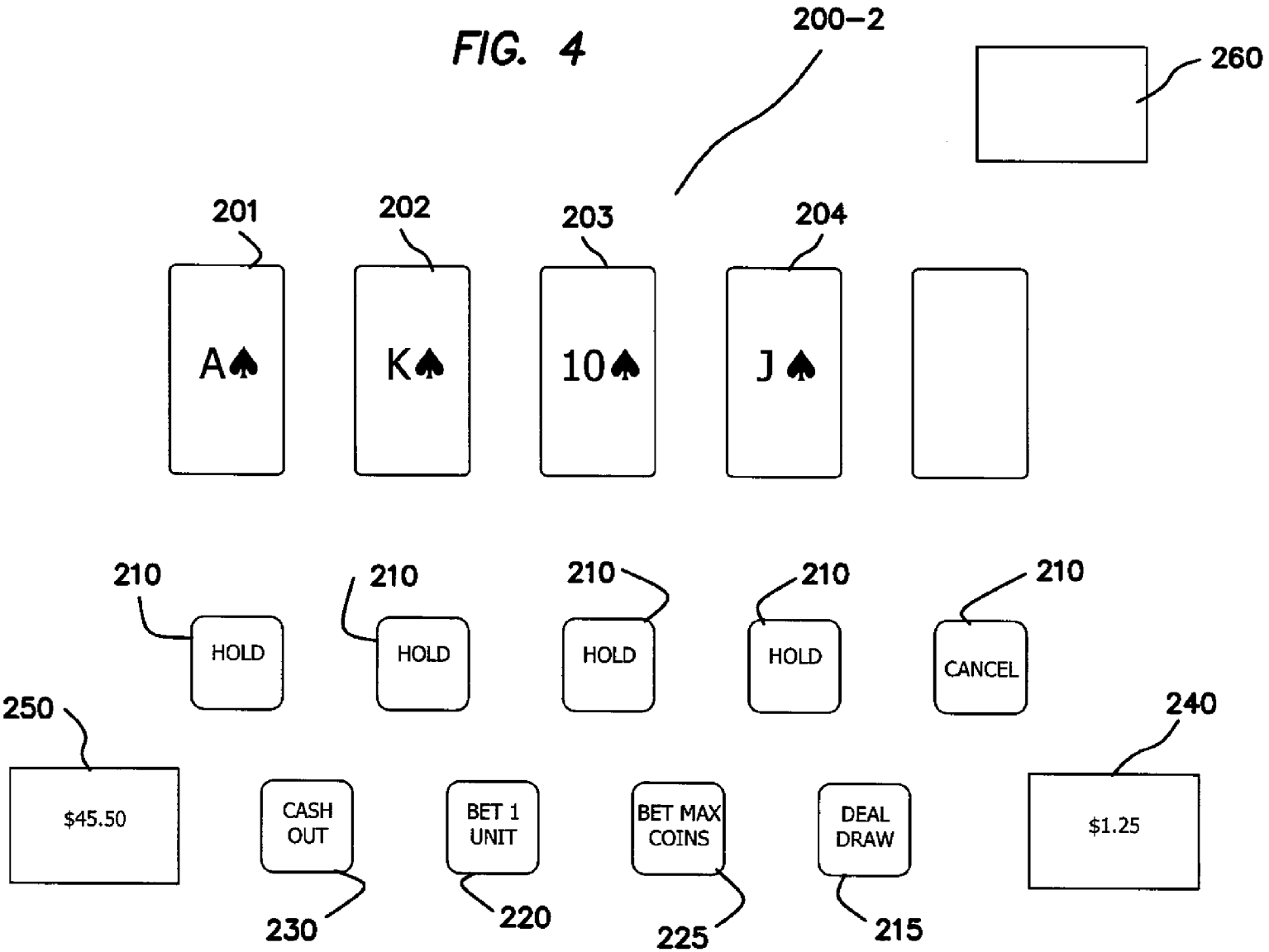
FIG. 4 illustrates a second screen shot of a video poker device according to the embodiments of the present invention.
Figure 5:
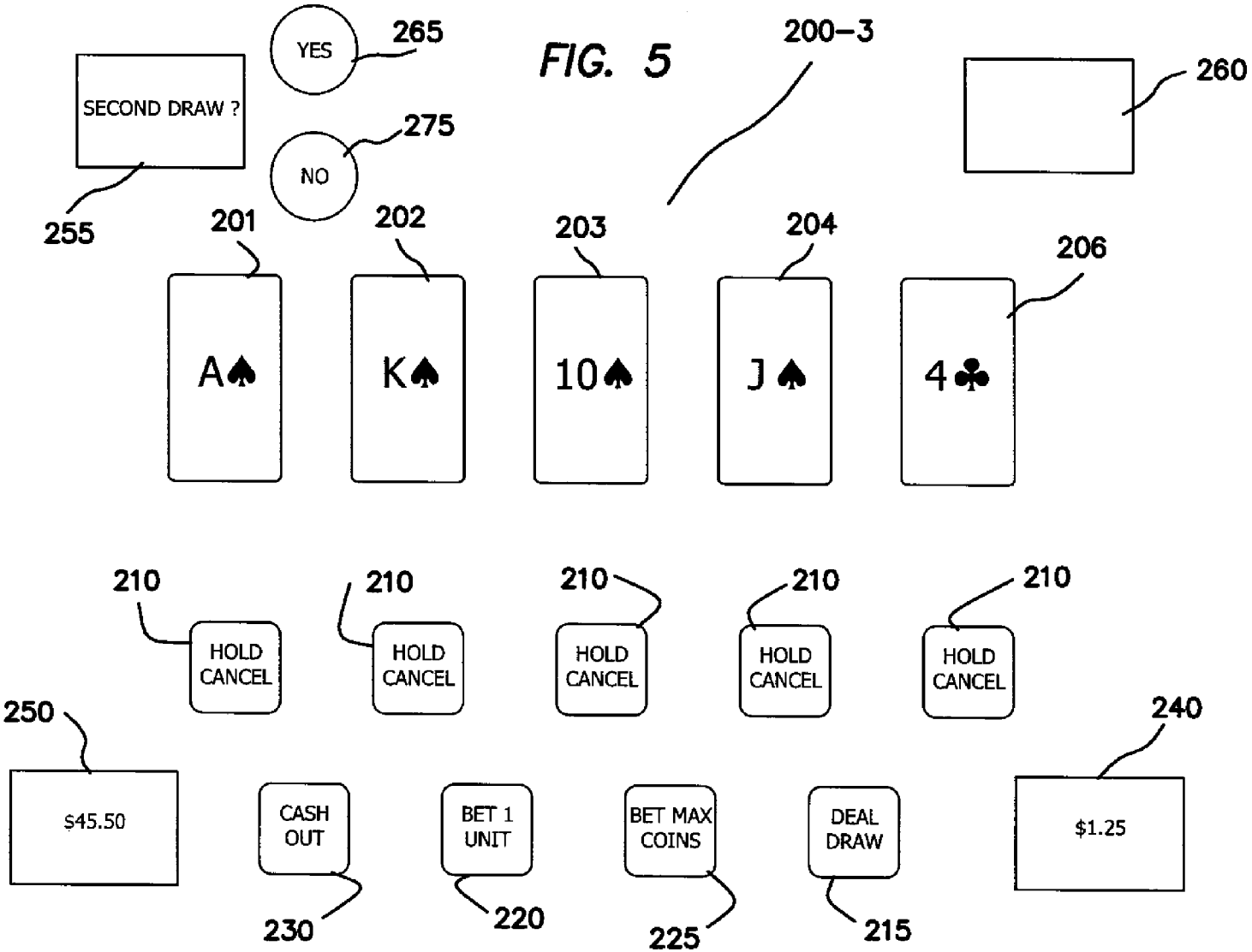
FIG. 5 illustrates a third screen shot of a video poker device according to the embodiments of the present invention.

FIG. 4 shows a second screen shot 200-2 after the player has elected to hold the four cards to the royal flush and discard the 7♥ 205. FIG. 5 shows a third screen shot 200-3 depicting a replacement card 4♣206 having been dealt to the player in place of the discard 205. As the player did not obtain the royal flush, the player may, based on the initial dealt hand, take advantage of the second draw opportunity. A "Second Draw?" query icon 255 is presented to the player. To elect the second draw opportunity the player presses the "Yes" icon 265 and/or places a second wager and to decline the player may press the "no" icon 275. Ideally, the second wager is equal to the first wager. In this instance, the second wager is $1.25 equaling the first wager as reflected in window 240. Alternatively, the amount of the required second wager may be greater than or less than the first wager.

Figure 6:
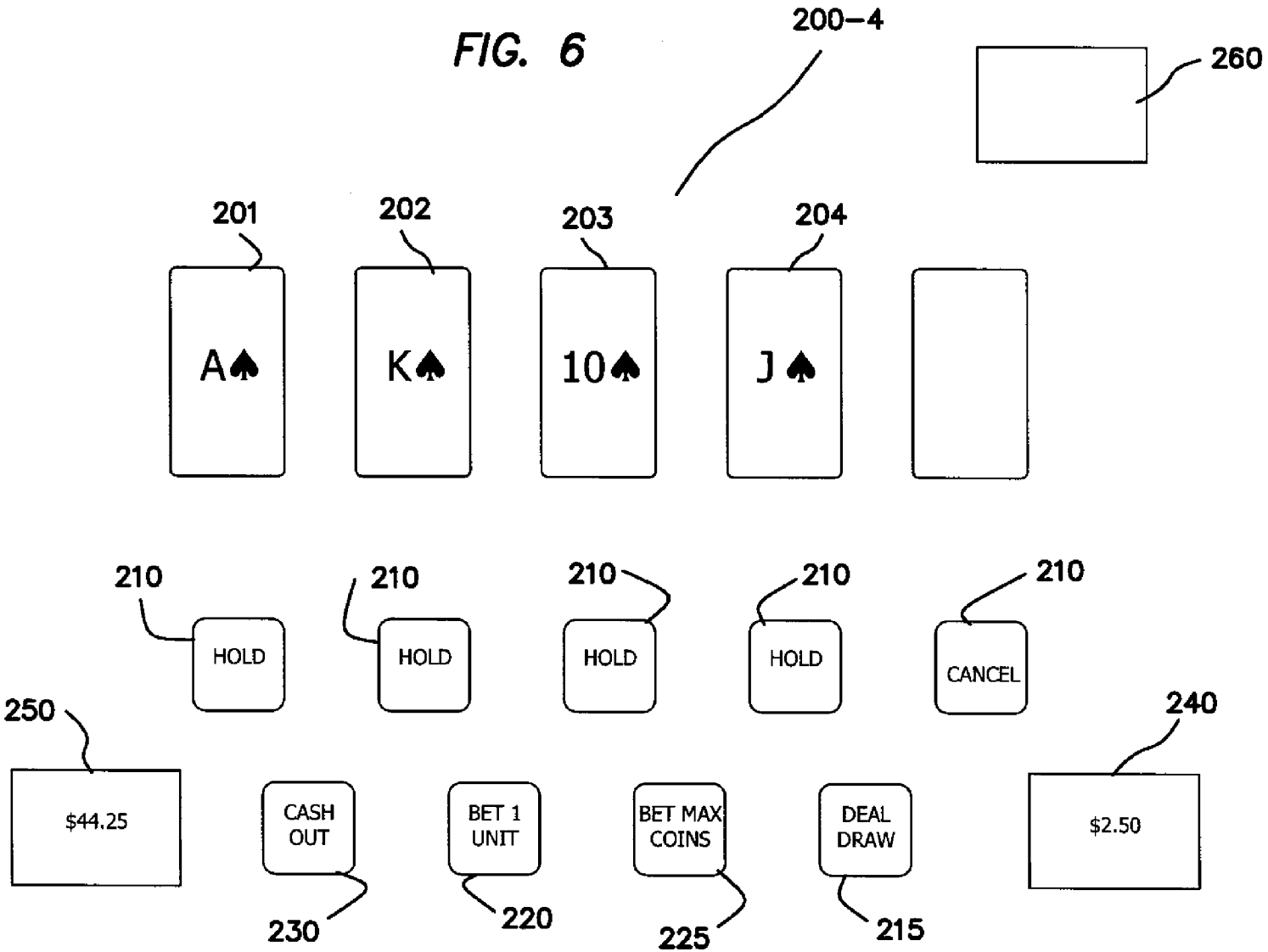
FIG. 6 illustrates a fourth screen shot of a video poker device according to the embodiments of the present invention.
Figure 7:
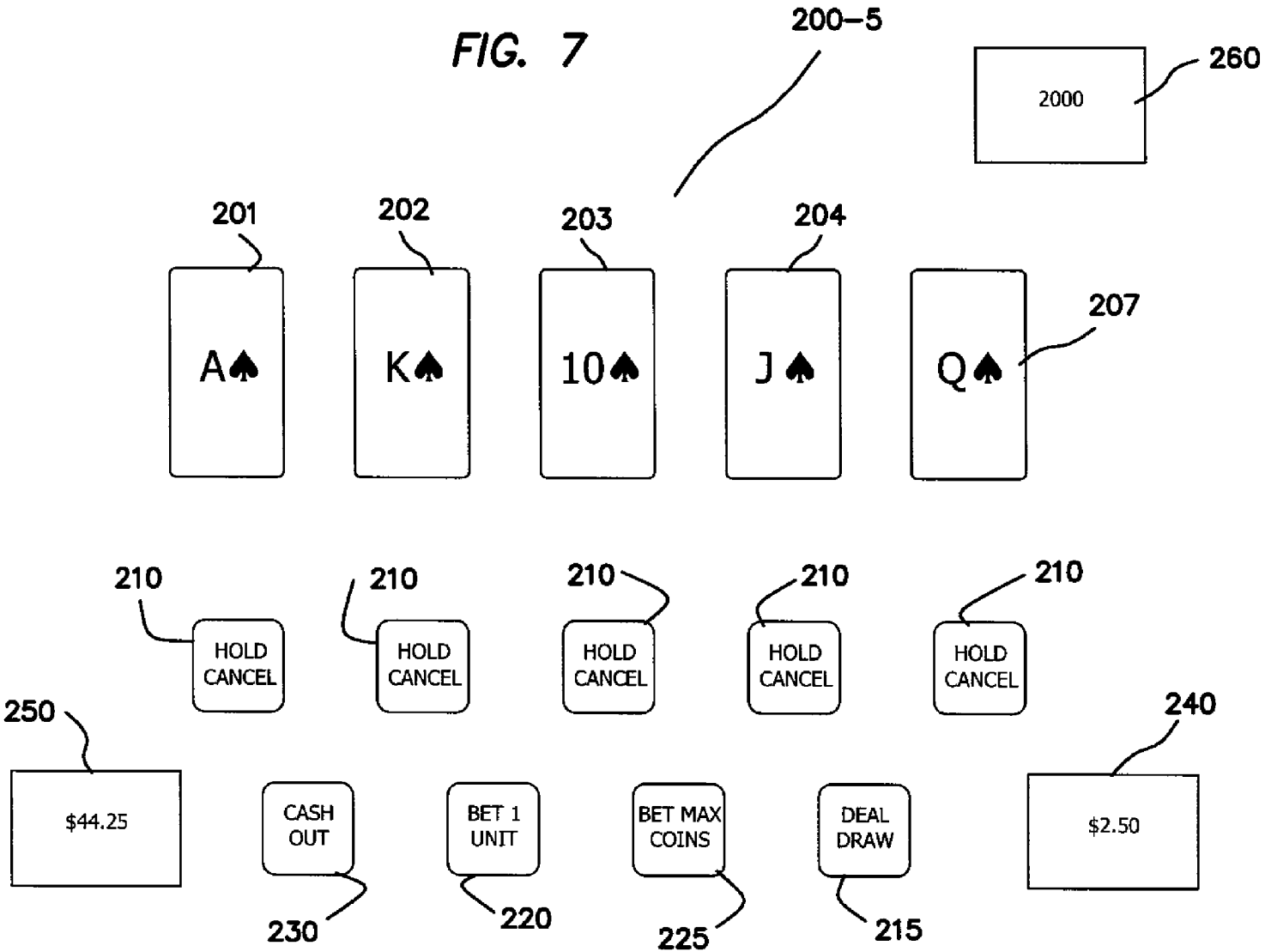
FIG. 7 illustrates a fifth screen shot of a video poker device according to the embodiments of the present invention.

FIG. 6 shows a fourth screen shot 200-4 after the player has deposited the second wager (the credits played window 240 shows the first and second wager and the total credits available window 250 shows the $1.25 deducted) to participate in the second draw opportunity and elected to hold the four cards to the royal flush and discard the 4♣206. As shown in screen shot 200-5 of FIG. 7, the player has now been provided with the Q♠207 to form a royal flush. As the player opted to utilize the second draw opportunity, the player is paid according to an alternative pay table 300 shown in FIG. 9. The two draw pay table 300 includes decreased payouts for those hands, namely the royal flush, straight flush and four of kind, which, based on the second draw, have an increased chance of being obtained by the player. As shown, the royal flush payout 301, straight flush payout 302 and four of a kind payout 303 have been decreased by approximately 50% over the corresponding payouts in the conventional pay tables shown in FIGS. 2*a*-2*e*. The payout of 2000 coins or units is reflected in payout window 260. Those skilled in the art will recognize that the payouts may be modified according to a different percentage as long as the pay table 300 provides a suitable house edge or advantage. Moreover, if other initial hands are used to trigger the second draw opportunity, payouts related to other final hands may be modified as well.

After the player completes the first draw, the resultant poker hand may be a winning hand while not being the target hand. For example, a player being dealt the initial hand shown in FIG. 3 would elect to hold the A♠201, K♠202, 10♠203 and J♠204 and discard the 7♥ 205 to try for the royal flush. On the draw, the 7♥ 205 may be replaced with another spade but not the Q♠ such that the resultant hand is a flush which has a corresponding payout in all video poker pay tables. Depending on the embodiment of the game, the player may be permitted to retain the flush payout and then place a second wager to try and obtain the royal flush or other winning outcome (e.g., another flush) or the player may be required to forfeit the first payout for the opportunity to try a second time at obtaining a royal flush.

Figure 8A:
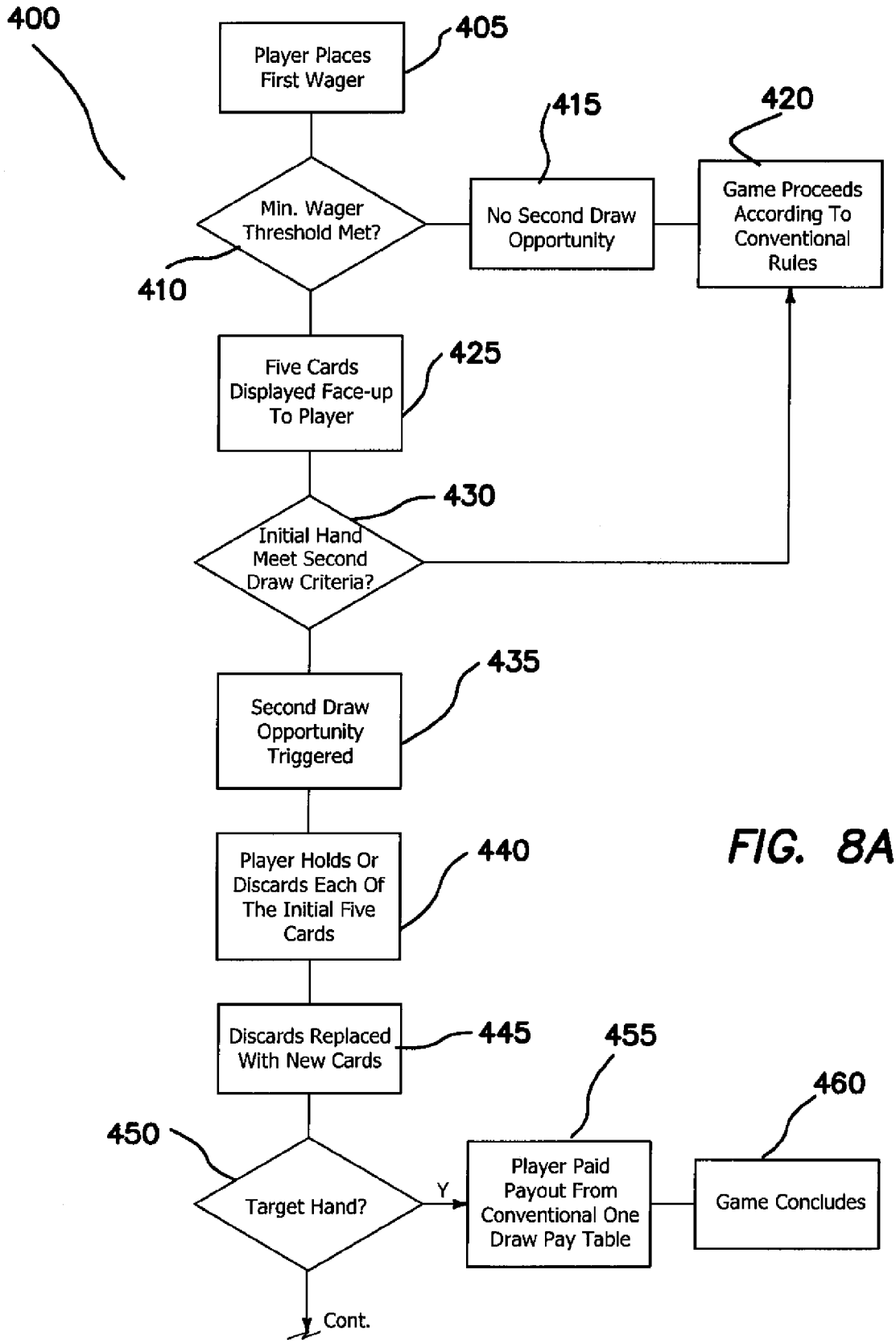
FIGS. 8*a*-8*b* illustrate a flow chart detailing one embodiment of the present invention.
Figure 8B:
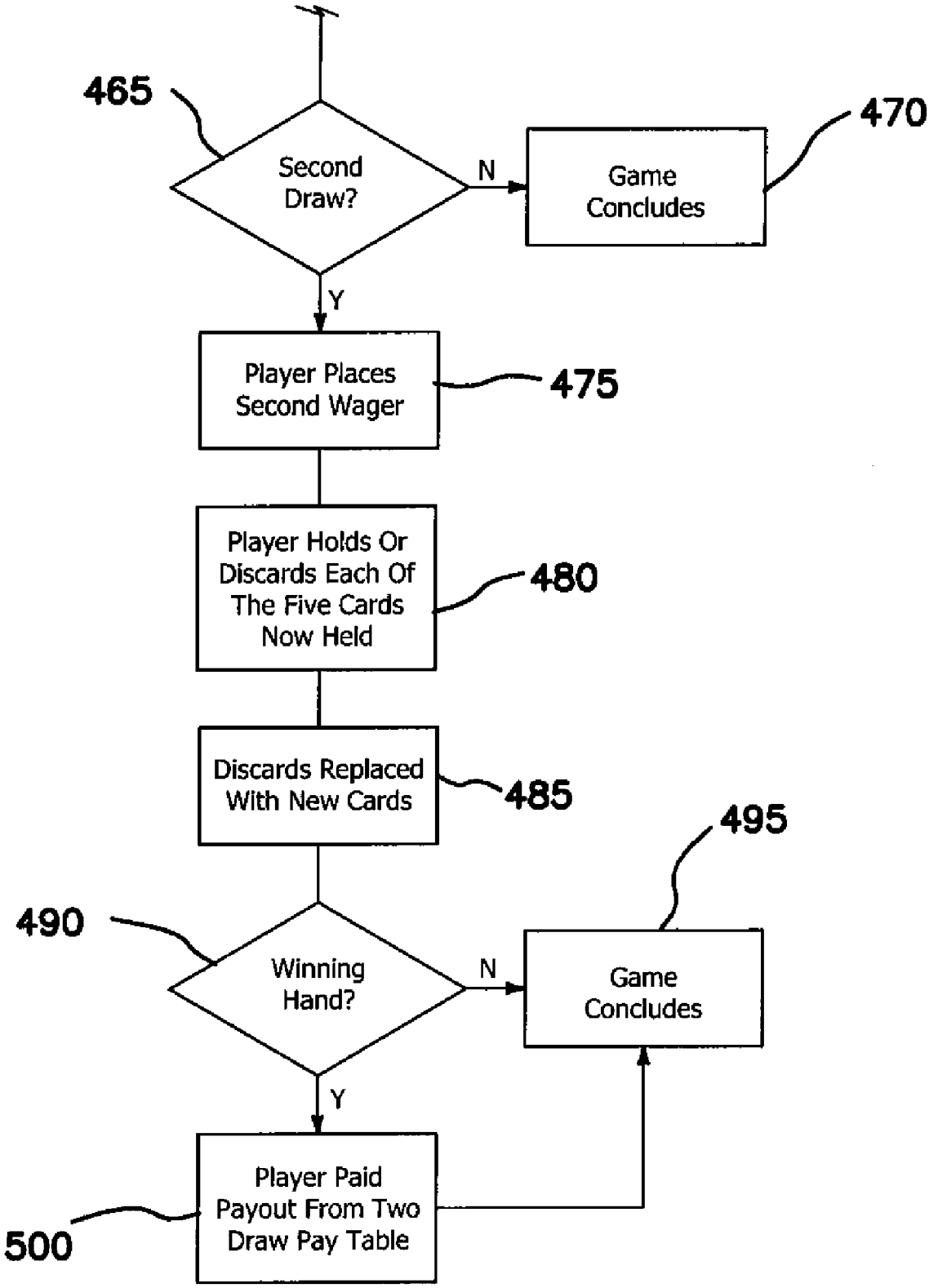

Now referring to FIGS. 8*a* and 8*b*, a flow chart 400 details one method of conducting a video poker game according to the embodiments of the present invention. At 405, the player places a first wager. At 410, it is determined by the machine or device processor whether the wager meets a minimum threshold. This is an optional feature and is not mandatory to trigger the second draw opportunity. At 415, if the wager fails to meet a minimum threshold value, the second draw opportunity is not made available and, at 420, the game proceeds in a conventional video poker manner. If the wager meets a minimum threshold or there is no such requirement, at 425, five random cards are displayed face-up to the player. At 430, it is determined by the machine or device processor whether the initial cards meet the requirements necessary to trigger or activate the second draw opportunity. As set forth above, the requirements may be that the initial five cards include four cards to a royal flush or straight flush, or three cards to a four of a kind. If the initial cards meet the requirements to trigger the second draw opportunity, at 435, the processor triggers and maintains the second draw opportunity status as active. If the initial cards do not meet the requirements, at 420, the game proceeds in a conventional video poker manner. At 440, the player elects which cards to hold and discard. In one embodiment, the held cards must be those initial cards which activated the second draw opportunity otherwise the second draw opportunity is deactivated. In another embodiment, the second draw opportunity remains active regardless of which initial cards the player holds. At 445, the processor causes the discard or discards to be replaced with one or more replacement cards from the shuffled deck of cards. At 450, the processor determines whether the resultant poker hand is a target hand as triggered by the second draw opportunity. That is, in this exemplary embodiment, it is determined if the resultant hand is a royal flush, straight flush or four of a kind. If so, at 455, the player is paid a payout from a first conventional (one draw) video poker pay table corresponding to the offered video poker game and, at 460, the game concludes. In other words, the player does not need a second draw because the player has obtained the target or desired hand and associated payout. If the resultant hand is not a royal flush, straight flush or four of a kind, at 465, the player is afforded the option to participate in the second draw opportunity. In one embodiment, the player is provided a "Second Draw?" query on the machine or device screen. At 470, should the player desire to not participate in the second draw opportunity, the player may simply decline and the game ends. At 475, if the player desires to participate in the second draw opportunity, the player places a second wager. Ideally, the second wager is equal to the first wager but the second wager can also be less than or greater than the first wager depending on the attitude and desire of the casino offering the game. At 480, the player again selects which cards from the initial hand to hold and discard. Most likely, the player will discard the one or two replacement cards because they did not result in the royal flush, straight flush or four of a kind. In an alternative embodiment, the player is able to hold and discard cards from the final hand after the first set of replacement cards have been dealt. At 485, the processor causes the discard or discards to be replaced with one or more new replacement cards from the shuffled deck of cards. At 490, the processor determines the rank of the final poker hand. If the hand does not merit a payout the game ends without a payout at 495. If a payout is warranted, at 500, one is made from a second (two draw) pay table.

As shown in FIG. 9, certain payouts listed in the second (two draw) pay table are decreased over corresponding payouts in the first (one draw) pay table to account for the additional draw opportunity. In pay table 300 of FIG. 9, the royal flush, straight flush and four of a kind payouts are 50% (or rounded of to a value as close thereto as possible) of the values in the conventional pay table (e.g., jacks or better pay table shown in FIG. 2*a*). The 50% payout are implemented across all wager amounts but if the game required a minimum wager threshold, the 50% payouts would be limited to those wager amounts equal to or exceeding the minimum threshold.

Advantageously, the embodiments of the present invention afford players a greater opportunity to obtain low frequency, high-paying poker hands while providing the house with additional revenue based on the placement of the second wager. The embodiments of the present invention may be facilitated by electronic gaming devices or machines, hand-held devices, global computer networks (e.g., the Internet) and the like.

Although the invention has been described in detail with reference to several embodiments, additional variations and modifications exist within the scope and spirit of the invention as described and defined in the following claims.

We claim:

1. A method of conducting an electronic poker game on an electronic gaming device wherein said electronic gaming device includes at least a display and player interface, comprising computer implemented steps of:

allowing a player to place a first wager;

providing the player with a plurality of random face-up cards forming a dealt hand;

if the dealt hand forms one or more pre-established poker hands, triggering a second draw opportunity;

allowing for a first time the player to hold or discard each of the provided random cards forming the dealt hand;

replacing each discard with first new random card forming a first draw hand;

if the second draw opportunity has been triggered, offering the player, for a second wager, a second opportunity to hold or discard one or more of the provided random cards forming said dealt hand; and if the player elects the second draw opportunity triggered by the dealt hand, allowing for a second time the player to hold or discard one or more of the provided random cards forming the dealt hand and replacing each discard with a second random card forming a second draw hand and providing a payout from a two draw pay table to the player based on a rank of the second draw hand.

2. The method of claim 1 further comprising providing the player a payout from a one draw pay table after allowing for the first time the player to hold or discard each of the random cards forming the dealt hand.

3. The method of claim 1 further comprising requiring the player to forfeit any payout, from a one draw pay table after allowing for the first time the player to hold or discard each of the random cards forming the dealt hand, in order to participate in the second draw opportunity.

4. The method of claim 1 further comprising requiring the second wager to be equivalent to the first wager.

5. The method of claim 1 further comprising providing five random cards to form the dealt hand and establishing four cards to a royal or straight flush, or three cards to a four of a kind, as the one or more pre-established poker hands.

6. The method of claim 1 further comprising requiring the first wager to meet or exceed a threshold value in order to activate the second draw opportunity.

7. The method of claim 1 further comprising decreasing certain payouts in the two draw pay table from corresponding payouts set forth in a one draw pay table.

8. The method of claim 1 further comprising triggering the second draw opportunity only if the random face-up cards forming the dealt hand comprise one or more pre-established poker hands and the player holds trigger cards.

9. A method of conducting an electronic poker game on an electronic gaming device wherein said electronic gaming device includes at least a display and player interface, comprising computer implemented steps of:

allowing a player to place a first wager;

providing the player with five random face-up cards forming a dealt hand;

if the five cards forming the dealt hand comprise one or more pre-established poker hands, activating a second draw opportunity;

allowing for a first time the player to hold or discard each of the five cards;

replacing each discard with a first new random card forming a first draw hand;

if the second draw opportunity has been activated, offering the player, for a second wager, a second opportunity to hold or discard one or more of the five cards forming the dealt hand; and if the player elects the second draw opportunity, allowing for a second time the player to hold or discard one or more of the five cards forming the dealt hand and replacing each discard with a second random card forming a second draw hand and providing a payout from a two draw pay table to the player based on a rank of the second draw hand.

10. The method of claim 9 further comprising providing the player a payout from a one draw pay table after allowing for a first time the player to hold or discard each of the five cards forming the dealt hand.

11. The method of claim 9 further comprising requiring the player to forfeit any payout, from a one draw pay table after allowing for a first time the player to hold or discard each of the five cards forming the dealt hand, in order to participate in the second draw opportunity.

12. The method of claim 9 further comprising requiring the second wager to be equivalent to the first wager.

13. The method of claim 9 further comprising requiring the first wager to meet or exceed a threshold value in order to activate the second draw opportunity.

14. The method of claim 9 further comprising decreasing certain payouts in the second draw pay table from corresponding payouts set forth in a one draw pay table.

15. The method of claim 9 further comprising triggering the second draw opportunity only if the random face-up cards forming the dealt hand comprise one or more pre-established poker hands and the player holds trigger cards.

16. A method of conducting an electronic poker game on an electronic gaming device wherein said electronic gaming device includes at least a display and player interface, comprising computer implemented steps of:

allowing a player to place a first wager;

providing the player with five random face-up cards forming a dealt hand;

if the five cards forming the dealt hand comprise one or more pre-established poker hands, triggering a second draw opportunity;

allowing for a first time the player to hold or discard each of the five cards forming the dealt hand;

replacing each discard with a new random card forming a first draw hand;

offering a payout from a one draw pay table;

if the second draw opportunity has been triggered, offering the player, for a second wager equaling the first wager, a second opportunity to hold or discard one or more of the five cards forming the dealt hand; and if the player elects the second draw opportunity, allowing for a second time the player to hold or discard one or more of the five cards forming the dealt hand and replacing each discard with a random card forming a second draw hand and providing a payout from a two draw pay table to the player based on a rank of the second draw hand.

17. The method of claim 16 further comprising allowing the player to collect the payout from the one draw pay table and participate in the second draw opportunity.

18. The method of claim 16 further comprising requiring the player to forfeit any payout, from the one draw pay table in order to participate in the second draw opportunity.

19. The method of claim 16 further comprising establishing four cards to a royal flush or straight flush, or three cards to a four of a kind, as the one or more pre-established poker hands.

20. The method of claim 16 further comprising decreasing certain payouts in the two draw pay table from corresponding payouts set forth in the one draw pay table.

21. The method of claim 16 further comprising triggering the second draw opportunity only if the random face-up cards forming the dealt hand comprise one or more pre-established poker hands and the player holds trigger cards.

22. A method of conducting an electronic poker game on an electronic gaming device wherein said electronic gaming device includes at least a display and player interface, comprising computer implemented steps of:

allowing a player to place a first wager;

providing the player with a plurality of random face-up cards forming a dealt an initial hand;

allowing for a first time the player to hold or discard each of the provided random cards;

if the random face-up cards forming the dealt hand comprise one or more pre-established poker hands and the player holds trigger cards forming the one or more pre-established poker hands, triggering a second draw opportunity;

replacing each discard with a first new random card forming a first draw hand;

if the second draw opportunity has been triggered, offering the player, for a second wager, a second opportunity to hold the trigger cards; and if the player elects the second draw opportunity, allowing for a second time the player to hold the trigger cards and replace each first new random card with a second random card forming a second draw hand and providing a payout from a two draw pay table to the player based on a rank of the second draw hand.

* * * * *